United States Patent [19]

Katagiri et al.

[11] Patent Number: 4,743,130

[45] Date of Patent: May 10, 1988

[54] APPARATUS TO FACILITATE INITIAL PAPER LOADING

[75] Inventors: Koichi Katagiri; Satomi Nanaumi; Toshimasa Fujiwara, all of Tokyo, Japan

[73] Assignee: Copal Company Limited, Tokyo, Japan

[21] Appl. No.: 850,482

[22] Filed: Apr. 11, 1986

[51] Int. Cl.[4] ..... B41J 11/30

[52] U.S. Cl. ..... 400/613.2; 226/74; 400/616.1; 400/691

[58] Field of Search ..... 400/613.2, 613.3, 616.2, 400/691, 578, 613.1, 616, 616.1; 226/74, 89, 90, 91, 92; 235/58 CF, 58 P

[56] References Cited

U.S. PATENT DOCUMENTS

| | | | |
|---|---|---|---|
| 2,140,028 | 12/1938 | Nichols | 226/74 X |
| 3,334,722 | 8/1967 | Bernard | 400/613.2 X |
| 3,656,602 | 4/1972 | Konkel et al. | 400/616.2 X |
| 3,707,214 | 12/1972 | Ponzano | 400/616 X |
| 4,197,025 | 4/1980 | Kuelzer | 400/637 X |
| 4,454,975 | 6/1984 | Rosenberg | 400/616 X |
| 4,510,345 | 4/1985 | Costa et al. | 400/693 X |
| 4,564,305 | 1/1986 | Rekewitz et al. | 400/637 X |
| 4,605,145 | 8/1986 | Engelhardt et al. | 226/89 X |

*Primary Examiner*—Edgar S. Burr

*Assistant Examiner*—Moshe I. Cohen

*Attorney, Agent, or Firm*—McAulay, Fields, Fisher, Goldstein & Nissen

[57] ABSTRACT

The printer is for printing a continuous fan-folded paper web having series of perforations at each side edge thereof which is adapted to be fed into the printer from the bottom of the printer. The printer comprises an upper housing member swingably supported by a lower housing member so that the upper housing member is movable between a closed position for the printing operation and an opened position at which an accessible space is provided between the bottom of the upper housing member and the lower housing member. The upper housing member includes a printing mechanism and a pin-tractor mechanism for feeding the paper web a portion of which extends outwardly downwardly from the bottom of the upper housing member. The lower housing member has a feed-in opening at the bottom thereof for the paper web. Thus, the threading and advancing of the paper web into the printing mechanism by the pin-tractor mechanism are facilitated by swinging the upper housing member to the opened position providing the accessible space between the bottom of the upper housing member and the lower housing member where access to the pin-tractor mechanism is permitted.

12 Claims, 3 Drawing Sheets

APPARATUS TO FACILITATE INITIAL PAPER LOADING

BACKGROUND OF THE INVENTION

The present invention relates to a printer, and, more particularly, to a printer adapted to feed a continuous fan-folded paper web into the printer from the bottom thereof, wherein the initial loading of the paper web is greatly facilitated.

A printer of the impact dot type, the non-impact dot type and the like used as a print output device in various types of computers, word processors and the like has in general a friction roller mechanism for feeding each cut sheet and a pin-tractor mechanism for feeding a continuous paper web having series of perforations at each side edge thereof.

The supply of the perforated continuous paper web is in general effected from the rear side of the housing of the printer as shown in FIG. 3. In FIG. 3 the stack PS of the continuous perforated fan-folded paper web P is located at the rear side of the housing 100 of the printer. The paper web P is formed with a series of perforations PH at each side edge thereof, and the paper web P is guided around a platen 101 cooperating with a printing head 102 by means of a friction roller 103. The paper web P is fed by means of a pin-tractor mechanism out of the printer through a feed-out opening 104 formed at the top of the printer after printing on the paper web P is effected by the printing head 102 in cooperation with the platen 101 in the manner well known in the art. The pin-tractor mechanism comprises a pair of pin-tractors 105 located at the rear side of the paper web P at each side edge thereof adjacent to the feed-out opening 104 of the printer.

Each of the pin-tractors 105 comprises an endless pin-belt formed with a series of pins 107 thereon adapted to engage with the perforations PH of the paper web P and located in a tractor frame 106 so that the paper web P is fed when the pin-belt is driven by driving means (not shown). In order to permit the perforations PH of the paper web P to engage with the pins 107 and securely held in engagement therewith, a swingable guide plate **106*a* is swingably hinged to the tractor frame 106 at the front side of the paper web P so that, when the guide plate 106*a* is swung apart from the tractor frame 106, the paper web P can be loaded in the tractor frame 106 with the perforations PH thereof engaged with the pins 107, while, when the guide plate 106*a* is swung to its closed position after the pins 107 are engaged with the perforations PH, the engagement of the pins 107 with the perforations PH can be securely maintained during the time the paper web P is fed by the pin-tractors 105**.

In such a printer, an additional space is required at the rear side of the printer resulting in disadvantage in saving the space, even though the loading of the paper web P into the printer is made relatively easy by virtue of the friction roller 103. Further, when a paper web P to which pieces of paper such as tickets are attached is used, the pieces of paper sticking to the paper web P tend to be stripped off when the paper web P is moved around the platen 101 at the deflection angle of about 180°. Therefore, it is preferable to make the deflection angle of the paper web P around the platen 101 to be as small as possible.

In order to avoid the above disadvantages, a printer has been proposed in which the stack PS of the paper web P is arranged beneath the printer and paper web P is fed into the printer through a feed-in opening 108 provided at the bottom of the printer as shown in FIG. 4, thereby permitting the space required for the stack PS to be reduced to the minimum while the deflection angle of the paper web P around the platen 101 is greatly reduced.

In such a printer, however, the loading of the paper web P in the printer is made extremely difficult, because the operator must squat and look upwardly at the printer for loading the paper web P through the feed-in opening 108 and advancing between the platen 101 and the printing head 102 until the paper web P is engaged with the pin-tractor mechanism. Such an operation is extremely troublesome.

SUMMARY OF THE INVENTION

An object of the present invention is to provide a printer wherein the above described disadvantages of the prior art printers are avoided.

The above object is achieved in accordance with the characteristic feature of the present invention by the provision of a printer for printing a continuous fan-folded paper web which is fed into the printer from the bottom thereof, the printer comprising an upper housing member having a feed-in opening for the paper web at the bottom wall thereof, a lower housing member having a feed-in opening for the paper web at the bottom wall thereof, the upper housing member being swingably supported by the lower housing member so as to be swung between a closed position for the printing operation and an opened position providing an accessible space between the upper and lower housing members, a printing mechanism arranged within the upper housing member, and a feeding mechanism arranged in the upper housing member with a portion thereof extending through the feed-in opening outwardly therefrom for feeding the paper web toward and into the printing mechanism, thereby permitting the paper web to be loaded in the feeding mechanism when the upper housing member is in the opened position providing the accessible space for the loading of the paper web.

In a preferred embodiment of the present invention the paper web is provided with series of perforations at each side edge thereof, and the feeding mechanism comprises a pin-tractor mechanism consisting of a pair of pin-belts and tractor frames movably supporting the pin-belts, respectively, the pin-belts being located at each side of the paper web so that each pin-belt cooperates with the series of perforations of the paper web for feeding the same.

With the above construction of the printer according to the present invention, the loading of the paper web is greatly facilitated by virtue of the fact that the upper housing member is swung upwardly to the opened position to provide an accessible space between the upper and lower housing members into which a portion of the pin-tractors protrude so that the operator can easily load the paper web in the pin-tractors with the perforations thereof engaged with the pins of the pin-belts by swinging the guide plates apart from the tractor frames. After the perforations of the paper web are engaged with the pins of the pin-belts, the guide plates are swung to the closed position so that the engagement of the perforations of the paper web with the pins of the pin-belts is insured to permit the paper web to be fed without fail by the pin-tractor mechanism for the printing operation after the upper housing member is swung to the closed position.

DETAILED DESCRIPTION OF THE PREFERRED EMBODIMENT

Figure 1:
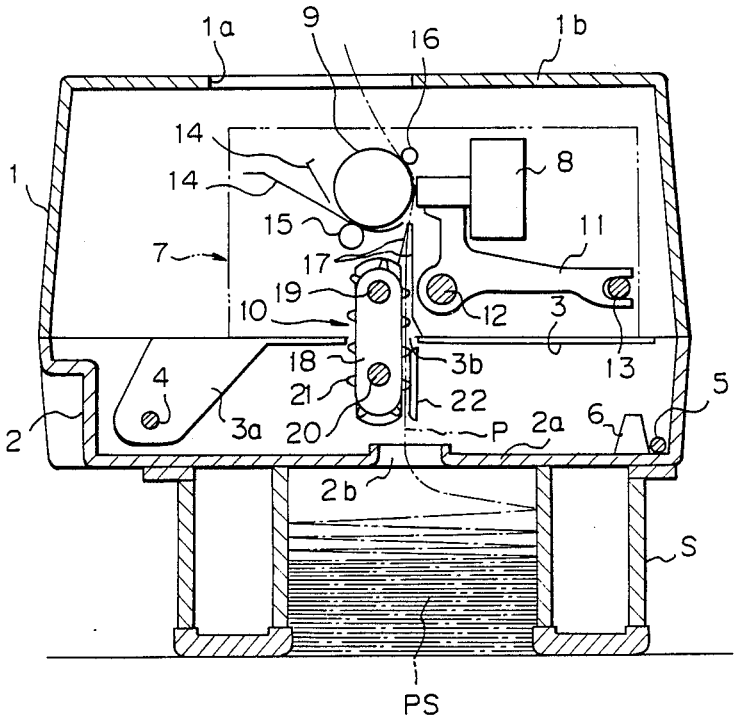
FIG. 1 is a cross-sectional view showing an embodiment of the printer constructed in accordance with the present invention, wherein the upper housing member of the printer is shown in the closed position for the printing operation.
Figure 4:
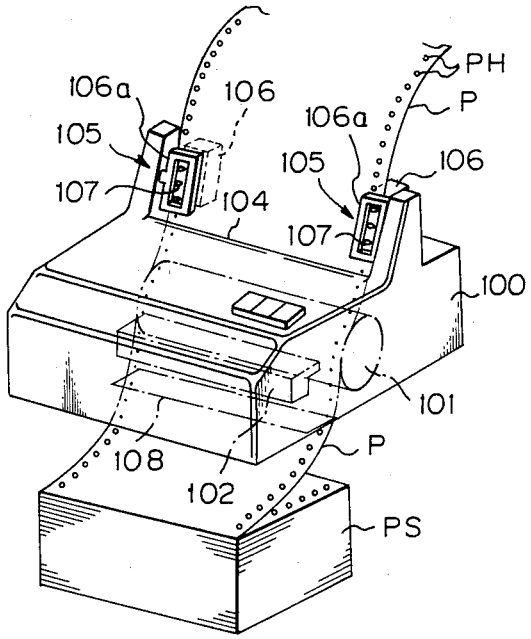
Fig. 4 PRIOR ART
FIG. 4 is a perspective view showing another example of the prior art printer.

Referring to FIG. 1, the preferred embodiment of the printer according to the present invention is adapted to be arranged on a stand S in which the stack PS of the continuous fan-folded perforated paper web P is loaded so that the paper web P is fed into the printer from the bottom of the printer in a like manner as described in connection with FIG. 4.

Figure 2:
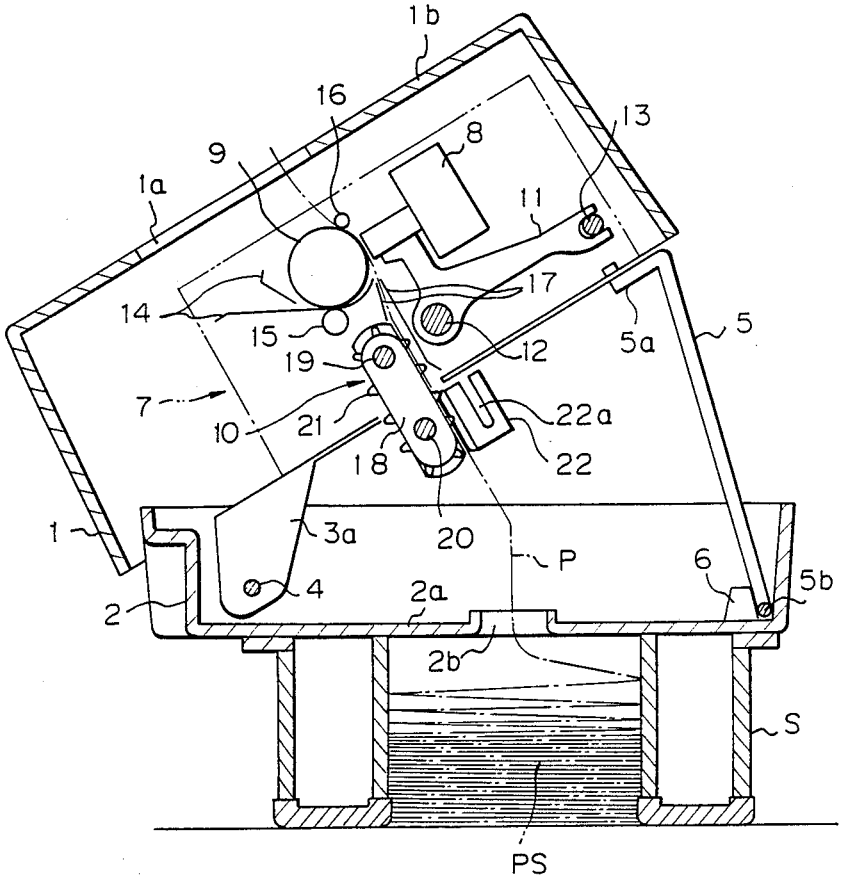
FIG. 2 is a cross-sectional view similar to FIG. 1 but showing the upper housing member in the opened position for loading the paper web in the pin-tractor mechanism.

The printer comprises an upper housing member 1 and a lower housing member 2. The upper housing member 1 has a bottom wall 3 formed with a bracket 3*a* at each side edge thereof and a feed-in opening 3*b* at about the center of the bottom wall 3 for feeding the paper web P therethrough into the upper housing member 1. The upper housing member 1 is swingably supported by the lower housing member 2 by a shaft 4 passing through the brackets 3*a* and secured to the lower housing member 2 so that the upper housing member 1 can be swung between a closed position in contact with the lower housing member 2 for the printing operation as shown in FIG. 1 and an opened position providing an accessible space between the upper and lower housing members 1,2 as shown in FIG. 2 at which the paper web P can be loaded in the printer to be described in detail hereinbelow, a supporting bar 5 being adapted to support the upper housing member 1 in the opened position with the upper bent portion 5*a* of the bar 5 engaging in a hole formed in the bottom wall 3 while the lower bent portion 5*b* being supported between the inner bottom corner of the lower housing member 2 and a projection 6 formed in the inner surface of the bottom wall 2*a*. The bottom wall 2*a* of the lower housing member 2 is formed with a feed-in opening 2*b* at the center thereof for feeding the paper web P therethrough into the lower housing member 2 from the stack PS in the stand S as shown in FIG. 1.

Figure 3:
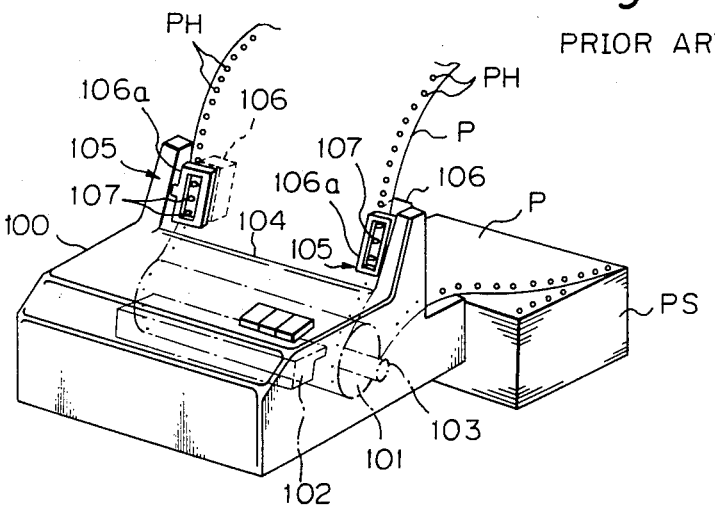
Fig. 3 PRIOR ART
FIG. 3 is a perspective view showing an example of the prior art printer.

The main mechanism 7 of the printer is housed in the upper housing member 1, and it comprises a printing head 8, a rotatable platen 9 cooperating with the printing head 8 for the printing operation and a pin-tractor mechanism arranged beneath the platen 9 and consisting of a pair of pin-tractors 10, 10 similar in construction and operation to the pin-tractors 105 described in connection with FIGS. 3 and 4. The printing head 8 is secured to a head carriage 11 which is slidably supported by a pair of parallel guide shafts 12, 13 secured to the upper housing member 1 so that the printing head 8 can be reciprocally traversed along the platen 9 for the printing operation. Paper guides 14, 14 are arranged around the platen 9 so as to guide each cut sheet fed around the platen 9 by a friction roller 15 cooperating with the platen 9. A bail roller 16 is arranged around the platen 9 at the discharging position of the paper web P or the cut sheet which has been printed. In order to permit the paper web P or the cut sheet to be fed out of the upper housing member 1, a feed-out opening 1*a* is formed at the top wall 1*b* of the upper housing member 1.

In order to guide the paper web P fed by the pin-tractors 10, 10 into the printing position between the printing head and the platen 9, paper guides 17, 17 are arranged between the pin-tractors 10, 10 and the printing position.

The pin-tractors 10, 10 are constructed in symmetry with respect to the central longitudinal line of feeding of the paper web P and each of the pin-tractors 10, 10 comprises a tractor frame 18 slidably supported by a driving shaft 19 driven by a reversible motor (not shown) and a guide shaft 20 parallel to the driving shaft 19 and also parallel to the guide shafts 12, 13, the shafts 19, 20 being rotatably supported in the upper housing member 1 by means not shown, an endless pin-belt formed with a series of pins 21 on the outer surface thereof for engaging with the perforations PH of the paper web P and stretched around the shafts 19, 20 so as to be driven by the driving shaft 19 for feeding the paper web P, and a swingable guide plate 22 having a groove 22*a* for loosely receiving the pins 21 and hinged at one side edge to the tractor frame 18 and spring-biased to a closed position and an opened position so that the guide plate 22 can positively maintain the engagement of the pins 21 with the perforations PH of the paper web P when it is urged and held at the closed position as shown in FIG. 1 while it permits the paper web P to be loaded in the pin-tractor 10 when the guide plate 22 is swung and held at the opened position as shown in FIG. 2.

Since the tractor frames 18 are slidably supported by the shafts 19, 20, the distance between the pin-tractors 10, 10 can be adjusted and fixed to the distance corresponding to the distance between the perforations PH of the both side edges of the paper web P to be printed.

A control circuit (not shown) of the printer is arranged in the lower housing member 2 so that, in the printing operation, the control circuit permits the paper web P to be fed by the pin-tractor mechanism in synchronism with the platen 9 at a speed corresponding to the peripheral speed of the platen 9 while the printing head 8 is reciprocally traversed along the platen 9 for the printing operation in timed relationship to the feeding of the paper web P as is well known in the art.

In accordance with the characteristic feature of the present invention, each of the pin-tractors 10, 10 of the pin-tractor mechanism is positioned in the feed-in opening 3*b* in the bottom wall 3 of the upper housing member 1 so that a portion (about a half of each of the entire pin-tractors 10, 10) extends outwardly of the upper housing member 1 and the guide plate 22*a* is located outside of the bottom wall 3 of the upper housing member 1 so that it can be manipulated by the operator when the upper housing member 1 is swung to the opened position as shown in FIG. 2 for loading the paper web P in the pin-tractors 10, 10.

As shown in FIG. 1, the path of movement of the paper web P loaded in the pin-tractors 10, 10 is adjacent to the feed-in opening 2*b* in the bottom wall 2*a* of the lower housing member 2 when the upper housing member 1 is brought to the closed position as shown in FIG. 1 so that feeding of the paper web P by the pin-tractors 10, 10 can be properly effected.

When the paper web P from the stack PS in the stand S is to be loaded in the printer, the upper housing member 1 is swung to the opened position and held thereat by the supporting bar 5 for providing an accessible space between the upper and lower housing members 1, 2 and the loading end of the paper web P pulled into the lower housing member 2 through the feed-in opening **2*b* is loaded onto the pin-tractors 10, 10 with the guide plates 22 swung in the opened position so as to permit the pins 21 to be engaged with the perforations PH of the paper web P and, thereafter, the guide plates 22 are swung to the closed position for insuring the engagement of the pins 21** with the perforations PH during the printing operation.

After the loading of the paper web P in the pin-tractors 10, 10 is completed, the supporting bar 5 is detached from the upper housing member 1 and the upper housing member 1 is swung to the closed position. Then, the printing operation can be effected by the actuation of an automatic switch coupled with the closing action of the upper housing member 1 or a manually operable switch which, upon actuation, actuates the control circuit to drive the pin-belts of the pin-tractors 10, 10 for feeding the paper web P to the platen 9 through the guide plates 17, 17.

After the paper web P has been sufficiently fed so as to be ready for printing operation, the bail roller 16 is pressed onto the platen 9 so that the printer is rendered to be ready for the printing operation.

As described above, since the upper housing member 1 can be swung to the opened position providing an accessible space between the upper and lower housing members 1,2 into which a portion of the respective pin-tractor 10 extends thereby permitting the same to be easily manipulated by the operator, the initial loading of the paper web P from the stack PS in the stand S located beneath the printer which is pulled into the lower housing member 2 through the feed-in opening **2*b*** is greatly facilitated.

Further, since the pin-tractors 10, 10 for feeding the paper web P are located below the platen 9, the portion of the printer in which the paper web P is guided after it has been printed can be made very small in comparison with the printer in which the pin-tractors are arranged at the feed-out opening of the printer, thereby permitting the size of the printer above the platen 9 to be limited to the minimum.

What is claimed is:

1. Device for printing a continuous fan-folded paper web in a printer capable of supplying said paper web from the bottom of said printer, comprising:

a lower housing member having a first feed-in opening at the bottom surface thereof;

an upper housing member swingably mounted on said lower housing member so as to be swung upwardly with respect to said lower housing member thereby selectively assuming a closed position close to said lower housing member for the printing operation and an opened position for permitting said paper web to be threaded therein;

a main printing mechanism mounted in said upper housing member and including a carriage mounting thereon a printing head and a platen;

a second feed-in opening formed in the bottom surface of said upper housing member, said second feed-in opening assuming a position located on a substantially vertical line defined by said first feed-in opening and the printing portion of said platen when said upper housing member assumes said closed position; and a pin-tractor mechanism mounted in said upper housing member and positioned between said platen and said first feed-in opening of said lower housing member for pushingly feeding said fan-folded paper web along said substantially vertical line into said printing portion of said platen, said pin-tractor mechanism having paper holding members engaging with pins of said pin-tractor mechanism for movably holding longitudinal side edges of said paper web, the portion of said pin-tractor mechanism where said paper holding members are located extending outwardly from said second feed-in opening toward said lower housing member.

2. The device according to claim 1, including paper guides arranged around said platen for guiding each cut sheet fed around said platen.

3. The device according to claim 1, wherein said printing mechanism is positioned downstream of said feeding mechanism.

4. The device according to claim 1, wherein said pin-tractor mechanism includes a swingable guide plate and means for spring-biasing thereof to a closed position and an opened position.

5. The device according to claim 1, wherein said paper web is provided with series of perforations at each side edge thereof, and said pin-tractor mechanism comprising a pair of pin-belts and tractor frames movably supporting said pin-belts, respectively, said pin-belts being located at each side of the paper web such that each pin-belt cooperates with the series of perforations of the paper web for feeding the same.

6. The device according to claim 5, wherein said tractor frames are supported by a driving shaft for driving said pin-belts and a guide shaft arranged in parallel to the plane of the paper web and perpendicular to the direction of feeding of the paper web so as to be shifted along said shafts, thereby permitting the distance between said pair of pin-belts to be adjusted to the distance corresponding to that between the series of perforations at each side edge of the paper web.

7. The device according to claim 5, said paper holding members including swingable guide plates swingable to a closed position to insure engagement of the perforations of the paper web with said pins for guiding the paper web fed by said feeding mechanism to said printer.

8. The device according to claim 5, wherein said pin-tractor mechanism includes a swingable guide plate for each said pin-belt having a groove for receiving the pins of said pin-belts, said swingable guide plate being hinged at one side to said tractor frame and spring-biased to a closed position and an opened position so that said guide plate can positively maintain the engagement of said pins with the perforations of the paper web.

9. The device according to claim 8, wherein said swingable guide protrudes at least from the bottom wall of said upper housing member toward and within said lower housing member.

10. Apparatus to facilitate initial paper loading into a printer for printing a continuous fan-folded paper web which is fed into said printer from the bottom thereof, said apparatus comprising:

a lower housing member including a bottom wall having a first feed-in opening for the paper web;

an upper housing member swingably mounted on said lower housing member so as to be swung upwardly relative thereto and including a bottom wall having a second feed-in opening for the paper web, said upper housing member housing therein a fixedly mounted printing mechanism having a printing head and a platen for assuming a closed position close to said lower housing member for a printing operation and an opened position providing an accessible space between said upper and said lower housing members for access to said upper housing member and to permit the paper web to be threaded therein; and a feeding mechanism fixedly mounted in said upper housing member and being swingable therewith with a portion thereof extending outwardly of said upper housing member through said feed-in opening in said upper housing member, said feeding mechanism extending outwardly from said upper housing member for feeding the paper web toward and into said printing mechanism from a position upstream thereof past said printing mechanism to a position downstream thereof, thereby permitting the paper web to be loaded in said feeding mechanism when said upper housing member is in said opened position providing said accessible space for the loading of the paper web.

11. Apparatus according to claim 10, including paper guides for guiding the paper fed by said feeding mechanism to the printer.

12. Apparatus according to claim 10, including paper guides arranged between said feeding mechanism and the printing head.

* * * * *